US005113347A

United States Patent [19]

Ohuchi et al.

[11] Patent Number: 5,113,347

[45] Date of Patent: May 12, 1992

[54] INTERNAL COMBUSTION ENGINE SPEED CONTROLLER FOR CONTROLLING A THROTTLE VALVE BYPASS WITH RESPECT TO THE ATMOSPHERIC PRESSURE

[75] Inventors: Hirofumi Ohuchi; Hajime Kako, both of Himeji, Japan

[73] Assignee: Mitsubishi Denki K.K., Tokyo, Japan

[21] Appl. No.: 555,009

[22] Filed: Jul. 20, 1990

[30] Foreign Application Priority Data

Aug. 19, 1989 [JP] Japan ..... 1-213626

[51] Int. Cl.[5] ..... F02D 41/06

[52] U.S. Cl. ..... 364/431.1; 364/431.05; 123/491; 123/327; 123/494

[58] Field of Search ..... 364/431.03, 431.07, 364/431.05, 431.1, 431.11; 123/327, 339, 494, 585, 491

[56] References Cited

U.S. PATENT DOCUMENTS 4,349,877 9/1982 Oyama et al. ..... 364/431.05
4,572,141 2/1986 Hasegawa et al. ..... 123/585 X
4,600,993 7/1986 Pauwels et al. ..... 364/431.05
4,716,871 1/1988 Sakamoto et al. ..... 123/339
4,864,998 9/1989 Onishi ..... 123/494 X
4,903,657 2/1990 Miyazaki et al. ..... 123/494 X
4,938,195 7/1990 Miyazaki et al. ..... 123/494 X

*Primary Examiner*—Parshotam S. Lall
*Assistant Examiner*—E. J. Pipala
*Attorney, Agent, or Firm*—Sughrue, Mion, Zinn, Macpeak & Seas

[57] ABSTRACT

An engine speed control apparatus including an air control valve which controls the cross-sectional area of a bypass passage provided so as to bypass the throttle valve of the engine. The apparatus also includes a control unit which controls a degree of opening of the air control valve on the basis of a synthesized quantity which is obtained by synthesizing a basic air quantity for maintaining a target engine speed and an engine speed feed-back correction quantity which effects to eliminate an error between the target speed and an actual engine speed. An atmosphere pressure sensor is used to detect an atmospheric pressure, and a correction circuit is used to ensure that the synthesized quantity corresponds with the detected atmospheric pressure the engine is started.

4 Claims, 6 Drawing Sheets

INTERNAL COMBUSTION ENGINE SPEED CONTROLLER FOR CONTROLLING A THROTTLE VALVE BYPASS WITH RESPECT TO THE ATMOSPHERIC PRESSURE

The present invention relates to an engine speed control apparatus for an internal combustion engine. More particularly, it relates to such an apparatus as to correct an engine speed in an idle state with an atmospheric pressure.

Heretofore, an amount of fuel supplied to an internal combustion engine is determined based on an amount of air supplied to the engine. It is, therefore, known that an actual speed of the engine can be controlled by controlling an amount of air supplied to the engine.

FIG. 9 is a flow chart which shows a conventional technique to control a speed of an internal combustion engine in an idle state.

In FIG. 9, determination is made as the whether or not the engine is stopped at step S101. When it is found that the engine is stopped, an initial value is set for an engine speed feed-back correction quantity $Q_{NFB}$ at step S102. Then, an atmospheric pressure is detected at step S103. At step S104, determination is made as to whether or not the engine is in an idle state. When the engine is in an idle state, an actual engine speed Ne is obtained at step S105. At step S106, a target speed Nt is obtained on the basis of the conditions of the engine. At step S107, a basic air quantity $Q_{BASE}$ is obtained by calculation. At step S108, an atmosperic-pressure-corrected air quantity $Q_{AP}$ is obtained on the basis of the atmospheric pressure value detected. At step S109, determination is made as to whether or not time measurement is conducted at a timing of 100 ms. When it is not the case, sequential step goes to step S112. When it is the case, sequential step goes to step S110. At step S110, a control gain ΔKI is calculated on the basis of an error Δn between the target speed Nt and the actual speed Ne. Then, a calculation of $Q_{NFB}+\Delta KI$ is carried out to renew the engine speed feed-back correction quantity $Q_{NFB}$ at step S111. At step S112, an operation Of $Q_{ISC}=Q_{BASE}+Q_{NFB}+Q_{AP}$ is conducted to renew an ISC (idle speed control) air quantity $Q_{ISC}$. At step S113, a duty ratio D is calculated on the basis of the ISC air quantity $Q_{ISC}$. Then, a degree of opening of the air control valve provided in the bypass passage which bypasses the throttle valve is controlled by a driving signal based on the duty ratio D at step S114. When the throttle valve is in the entirely opened state or in a nearly opened state, a pressure in an intake air 1 pipe at the downstream side of the throttle valve is detected as an atmospheric pressure by a pressure sensor at step S115. When it is detected that the throttle valve is in the state other than described above, no detecting operation is carried out.

When it is detected that the engine is in a non-idle state at step S104, a predetermined value $Q_{OPEN}$ is set for the ISC air quantity $Q_{ISC}$, and the sequential step goes to Step S113.

After the operation of step S115 has been finished, i.e. the operation reaches RETURN, sequential step goes back to step S101 to repeat the above-mentioned operations.

In the conventional engine speed control apparatus, there is a case that an atmospheric pressure can not be detected because the throttle valve is not sufficiently opened, even though there is a substantial change in the atmospheric pressure. In this case, an amount of air can be corrected by estimating a change of atmospheric pressure on the basis of the engine speed feed-back correction quantity $Q_{NFB}$, and thereafter, an actual change of atmospheric pressure is detected to conduct correction of an amount of air. The above-mentioned way requires duplicate corrections, and an amount of air to the engine is controlled by quantities which have been subjected to correction of atmospheric pressure twice. Accordingly, a shortage or a surplus of an amount of air is caused to thereby invite temporally an abnormal reduction or rise in engine speed in an idle state.

If the correction is not conducted by using the atmospheric pressure, the engine speed rapidly decreases or rises from the target speed for a while at, for instance, a high land when the engine is started by actuating the ignition key.

It is an object of the present invention to provide an engine speed control apparatus capable of eliminating an abnormal reduction or rise in engine speed in an idle state of an engine by detecting an atmospheric pressure so that the engine speed is corrected through the detected pressure at the time of starting the engine.

In accordance with the present invention, there is provided an engine speed control apparatus for an internal combustion engine which comprises an air control valve which controls the cross-sectional area of a bypass passage provided so as to bypass the throttle valve of the engine, a control unit which controls a degree of opening of said air control valve on the basis of a synthesized quantity which is obtained by synthesizing a basic air quantity for maintaining a target engine speed and an engine speed feed-back correction quantity which effects to eliminate an error between the target speed and an actual engine speed; an atmospheric pressure detecting means to detect an atmospheric pressure, and a correction means which corrects said synthesized quantity with the detected atmospheric pressure at the time of starting the engine.

In the following, a preferred embodiment of the engine speed control apparatus of the present invention will be described with reference to the drawings.

Figure 1:
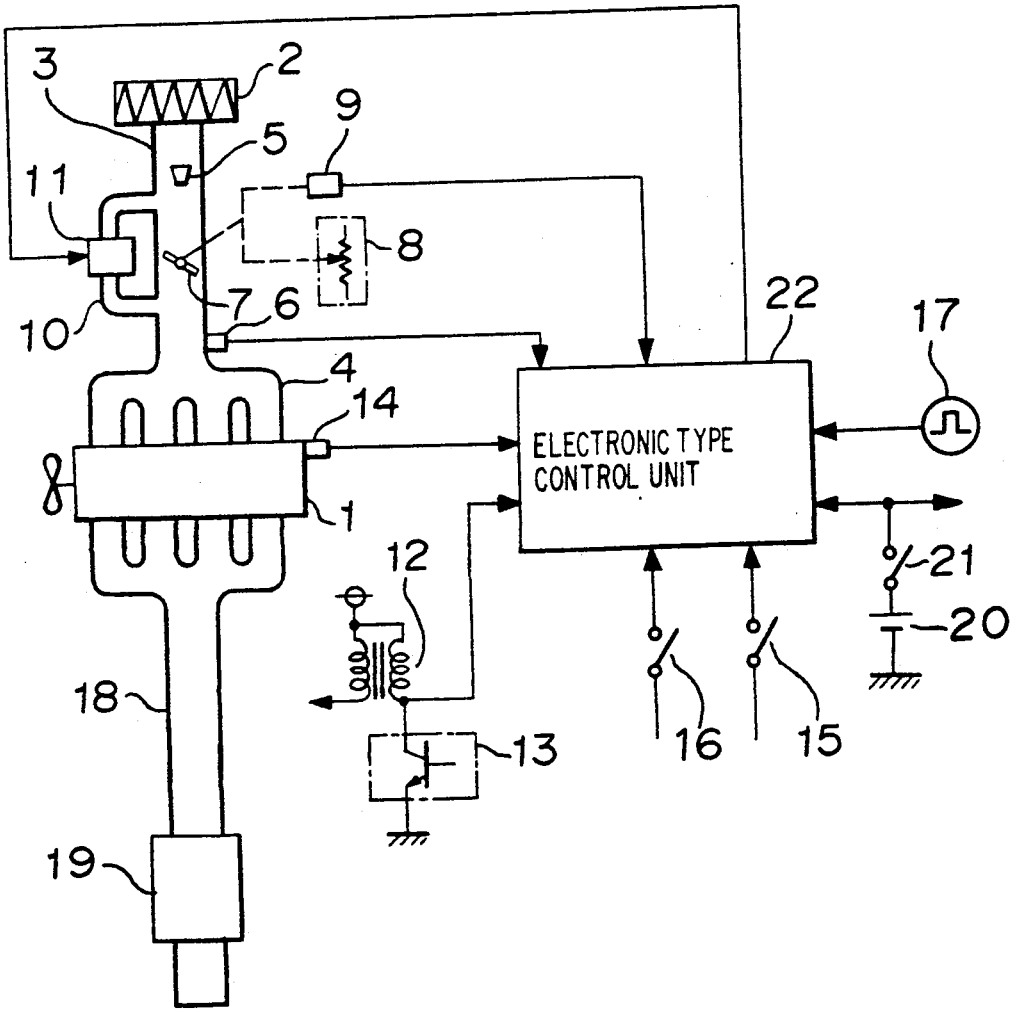
FIG. 1 is a diagram of an embodiment of the engine speed control apparatus according to the present invention.

FIG. 1 is a diagram showing a general construction of the embodiment according to the present invention.

In FIG. 1, a reference numeral 1 designates a spark ignition type internal combustion engine mounted on, for instance, a vehicle, The engine is to suck air through an air cleaner 2, an intake air pipe 3 and a branch pipe 4. Fuel is ejected in the intake air pipe 3 by an electromagnetic type fuel injection valve 5. A fuel control system (not shown) determines an amount of the fuel on the basis of a signal outputted from a pressure sensor 6 which detects as the absolute pressure value a pressure in the intake air pipe 3 at the downstream side of a throttle valve 7 which will be described below.

The throttle valve 7 is to adjust an amount of air sucked to the engine 1 by the operation of an accelerating pedal (not shown) by a driver. A numeral 8 designates a throttle sensor to detect a degree of opening of the throttle valve 7 and a numeral 9 designates an idle switch to detect the entirely closed state of the throttle valve 7. The idle switch generates an ON signal when it detects the entirely closing state of the throttle valve 7.

A numeral 10 designates a bypass passage which bypasses the throttle valve 7 located at the downstream side of the fuel injection valve 5 and a numeral 11 designates an air control valve provided in the bypass passage 10 to control the cross-sectional surface area of the passage. The air control valve is an electromagnetic control valve which opens at the degree of opening corresponding to the duty ratio D of a driving signal, for instance.

The ignition device of the engine 1 is connected to an ignition control system (not shown) which generates an ignition signal in accordance with a parameter indicating an operational condition of the engine. The ignition device is constituted by an igniter 13 which performs ON-OFF control of the primary current in an ignition coil 12 in response to the ignition signal, the above-mentioned ignition coil 12, a distributor (not shown) and an ignition plug (not shown).

A numeral 14 designates a cooling water temperature sensor to detect, for instance, a temperature of cooling water which represents a temperature of engine, a numeral 15 designates an electric load switch by which a load such as an air conditioner is connected, a numeral 16 designates a neutral switch which generates a signal for controlling an automatic transmission, and a numeral 17 designates a speed sensor which generates a pulse signal having a frequency in proportion to the revolution speed of an axle to thereby detect a speed of vehicle.

A numeral 18 designates an exhaust pipe, a numeral 19 designates a catalyst to purify exhaust gas, a numeral 20 designates a battery, and a numeral 21 designates an ignition key switch connected to the battery 20.

When the ignition key switch 21 is turned on, a starter (not shown) temporarily receives power from the battery 21 to start the engine 1. Further, the fuel control system and the ignition control system start fuel supply and ignition. When the ignition key switch 21 is in an OFF state, the fuel control system and the ignition control system are not operated because there is no supply of power from the battery 20. Accordingly, the engine 1 does not receive fuel from the fuel ignition valve 5 and the ignition plug (not shown) is not ignited.

A numeral 22 designates an electronic type control unit which receives each signal from the pressure sensor 6, the idle switch 9, the ignition coil 12, the cooling water temperature sensor 14, the electric load switch 15, the neutral switch 16, the speed sensor 17 and ignition key switch 21 so that a controlled variable for the air control valve 11 to perform feed-back control of the engine speed, or a controlled variable to perform open-looped control is calculated, whereby the actuation of the air control valve 11 is controlled.

Figure 2:
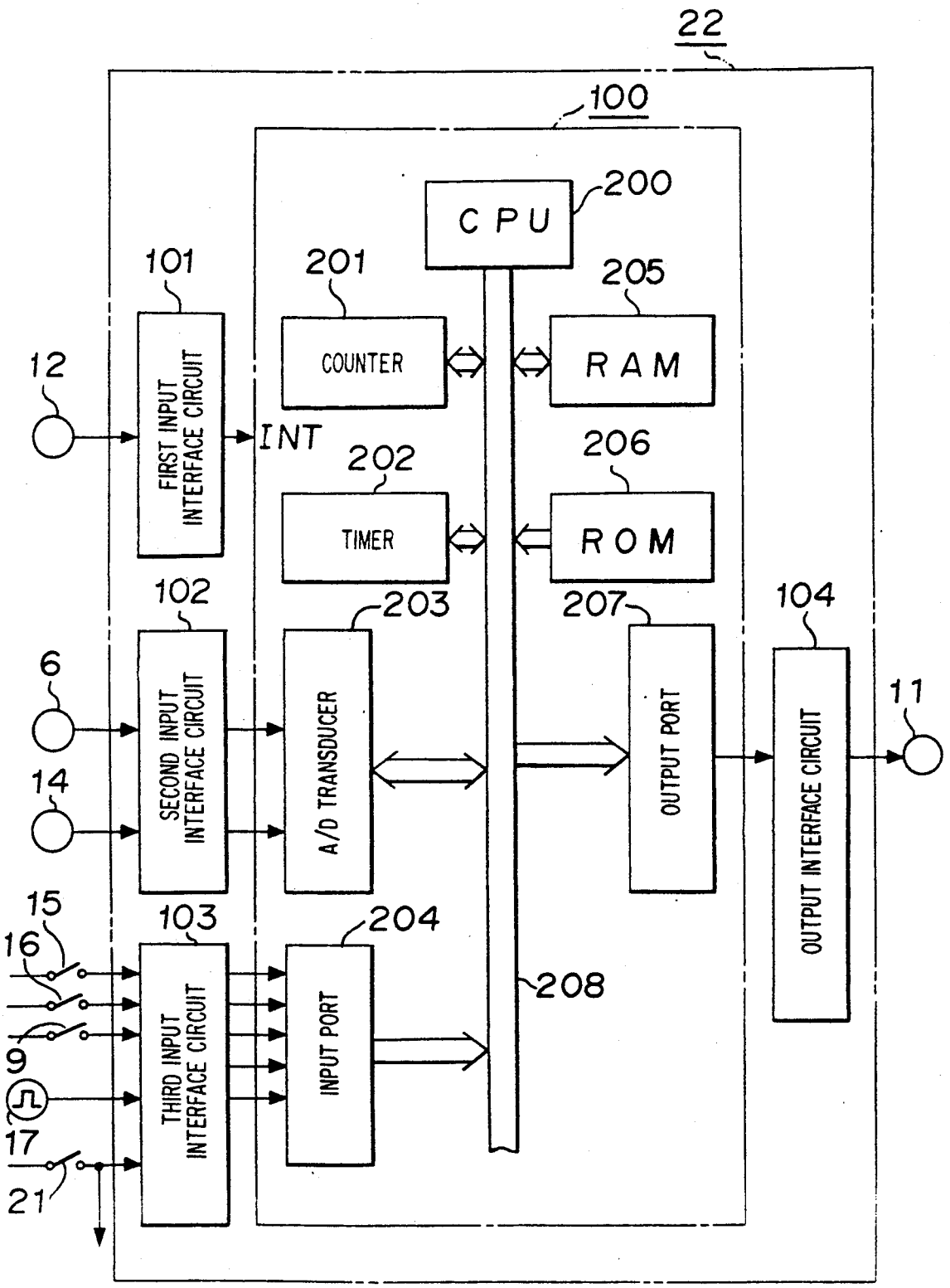
FIG. 2 is a block diagram showing a construction of an electronic type control unit as in FIG. 1.

The above-mentioned electronic type control unit 22 will be described with reference to FIG. 2.

Figure 3:
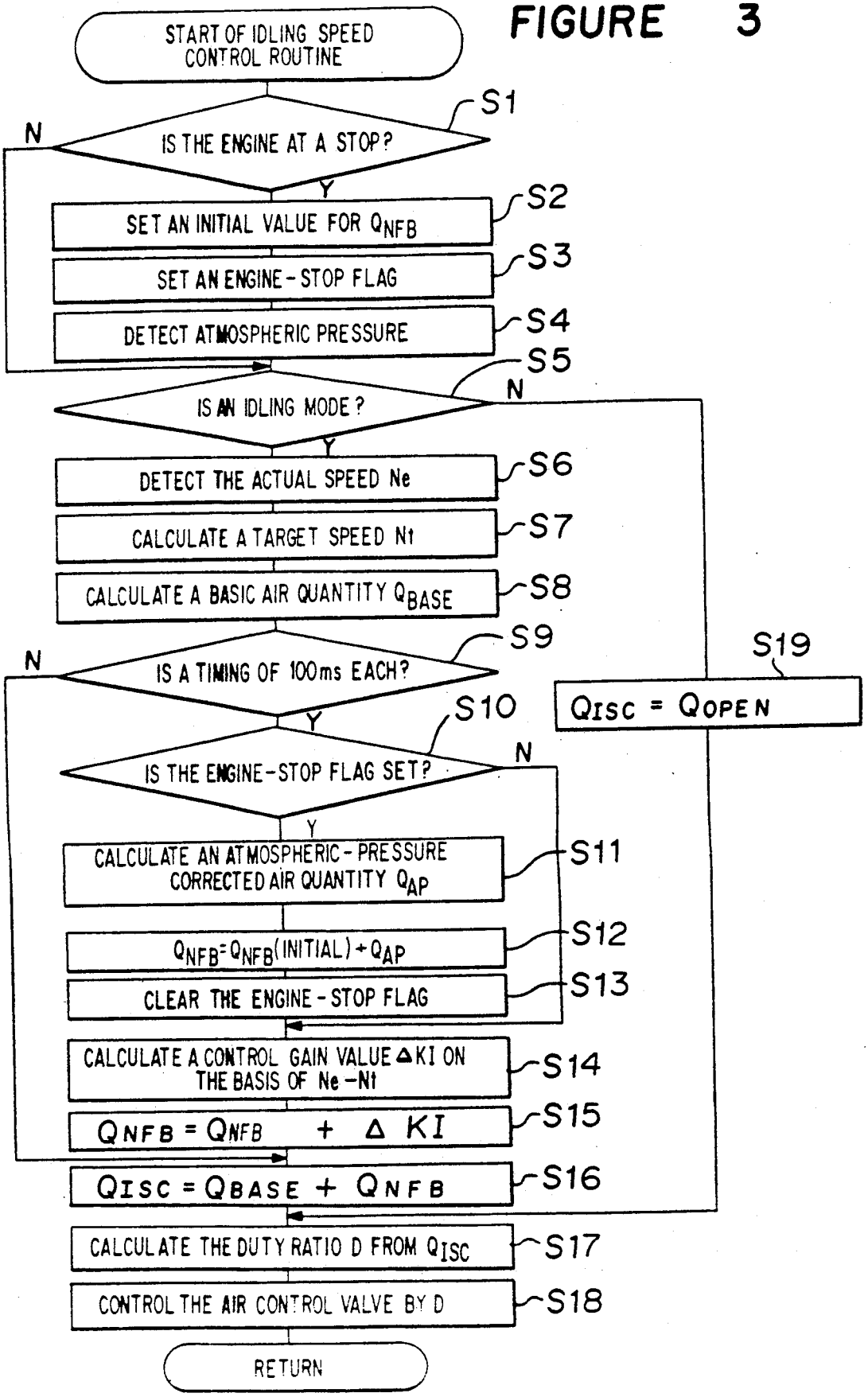
FIG. 3 is a flow chart showing the operations according to the embodiment of the present invention.

A numeral 100 designates a microcomputer which comprises a CPU200 which calculates, for instance, a controlled variable for the engine in an idle state in accordance with a predetermined program, a free-running counter 201 which measures a period of revolution of the engine 1, a plurality of timers 202 which measure a time of every 100 ms and the duty ratio D of a driving signal supplied to the air control valve, an A/D converter 203 which converts an analog input signal to a digital signal, an input port 204 which receives the digital signal without modification, an RAM205 which functions as a work memory, an ROM206 which stores a program such as a flow chart as shown in FIG. 3, an output port 207 which outputs driving signals, a common bus 208 and so on.

A numeral 101 designates a first input interface circuit which shapes the waveform of an ignition signal at the primary side of the ignition coil and outputs the shaped ignition signal as an interruption signal to the microcomputer 100.

When the interruption signal is produced, the CPU200 reads a value in the counter 201 and calculates the period of revolution number of the engine from the difference between the read value and the value read at the last time, the calculated value being stored in the RAM205.

A second input interface circuit 102 receives each signal from the pressure sensor 6 and the cooling water temperature sensor 14 and removes the noise components in the signals. The output signal of the second input interface circuit is outputted to the A/D converter 203.

A third input interface circuit 103 receives signals from the idle switch 9, the electric load switch 15, the neutral switch 16 and the ignition key switch 21, these signals being generated at the turning-on time, and a pulse signal from the speed sensor 17, and changes the levels of the signals to predetermined levels. The output signal of the third input interface circuit 103 is outputted to the input port 204.

A numeral 104 designates an output interface circuit which amplifies a driving signal from the output port 207 so that the amplified driving signal is outputted to the air control valve 11. A power source circuit (not shown) for the microcomputer always supplies power to the microcomputer 100 regardless of the condition of turning on or off of the ignition key switch 21.

The operation of the embodiment will be described with reference mainly to FIG. 3 among FIGS. 1 through 3.

At step S1, determination is made as to whether or not the ignition key switch 21 is turned on, i.e. the engine 1 is stopped on the basis of the signal of the ignition key switch 21. When it is found that the ignition key switch 21 is turned on, i.e. the engine is not stopped, sequential step jumps to step 5. On the other hand, when it is found that the ignition switch 21 is turned off, i.e. the engine is stopped, sequential step goes to step S2. At step S2, an initial value which takes the atmospheric pressure 760 mmHg as a standard, is set for an engine speed feed-back correction quantity $Q_{NFB}$.

At step S3, an engine-stop flag which represents a state of engine stop is set. At step S4, the atmospheric pressure value is read from the pressure sensor 6 through the second input interface circuit 102 and the A/D converter 203 because a pressure detected by the pressure sensor 6 indicates an atmospheric pressure because the engine 1 is stopped.

At step S5, determination is made as to whether or not the engine is in an idle state on the basis of the signal of the idle switch 9 and the signal of speed sensor 17. When it is found that the idle switch 9 is in an ON state and the speed of the vehicle is in a nearly stopped state, i.e. lower than 1.5 km/h, then, determination is made to be the idle state, and the sequential step goes to step S6. When it is found that the engine is in a non-idle state, step S19 is taken where the open-loop control is performed.

In the state that the engine is stopped, the ignition key switch 21 is in an OFF state and the power source for the idle switch 9 becomes OFF. Accordingly, the idle switch 9 outputs an OFF signal of an "L" level regardless of an ON state or an OFF state, and judgment of a non-idle state is made.

At step S6, an actual engine speed Ne is calculated on the basis of a period of rotation of the engine 1. At step S7, a target speed Nt is calculated on the basis of an operational condition of the engine 1. For the operational condition of the engine 1, a cooling water temperature value given by the cooling water temperature sensor 14, an ON state or an OFF state of the electric load switch 15, an ON state or an OFF state of the neutral switch 16 and so on are used.

At step S8, a basic air quantity $Q_{BASE}$ which requires to maintain the target speed Nt in response to the operational conditions is calculated.

At step S9, determination is made as to whether or not time measurement is carried out at the timing of 100 ms. When the time measurement is conducted at the timing of 100 ms, sequential step goes to step S10. When it is not the case, it jumps to step S16.

Figure 4:
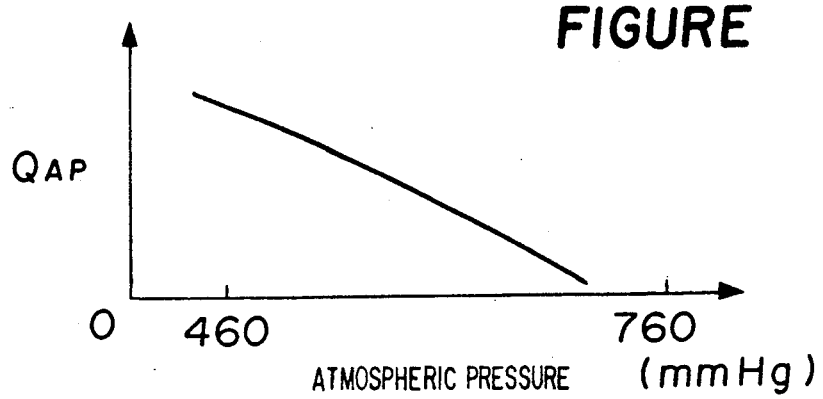
FIG. 4 is a diagram showing a relation of an atmospheric pressure to an atmosperic-pressure-corrected air quantity $Q_{AP}$.

At step S10, determination is made as to whether or not the engine-stop flag is set. When it is found that the flag is not set, sequential step jumps to step S14. When the flag is set, it goes to S11 where an atmospheric-pressure-corrected air quantity $Q_{AP}$ is calculated on the basis of the atmospheric pressure value read by the pressure sensor 6. The atmospheric pressure detected is in inverse proportion to the atmosperic-pressure-corrected air quantity $Q_{AP}$ as shown in FIG. 4.

At step S12, an engine speed feed-back correction quantity $Q_{NFB}$ is obtained by adding the atmospheric-pressure-corrected air quantity $Q_{AP}$ obtained at step S11 to the engine speed feed-back correction quantity $Q_{NFB}$ which has been set as an initial value at step S2. Namely, the engine speed feed-back correction quantity $Q_{NFB}$ is corrected with an atmospheric pressure. At step S13, the engine-stop flag is cleared, and then, Step S14 is taken.

Figure 5:
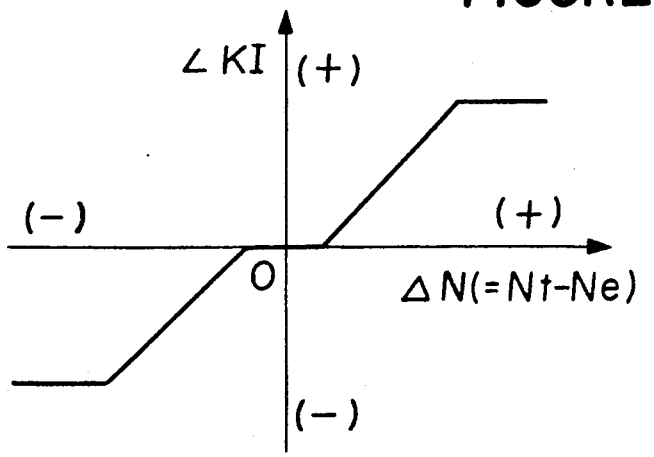
FIG. 5 is a diagram showing a relation Of an error of revolution number ΔN to a control gain ΔKI.

At step S14, a control gain ΔKI is calculated from an error of revolution number ΔN (between a target speed Nt and an actual engine speed Ne) by using a map as shown in FIG. 5 which represents a relation of ΔN to ΔKI. At step S15, the quantity $Q_{NFB}$ is renewed by adding the control gain ΔKI to the engine speed feed-back correction quantity $Q_{NFB}$ which is the latest information.

Figure 6:
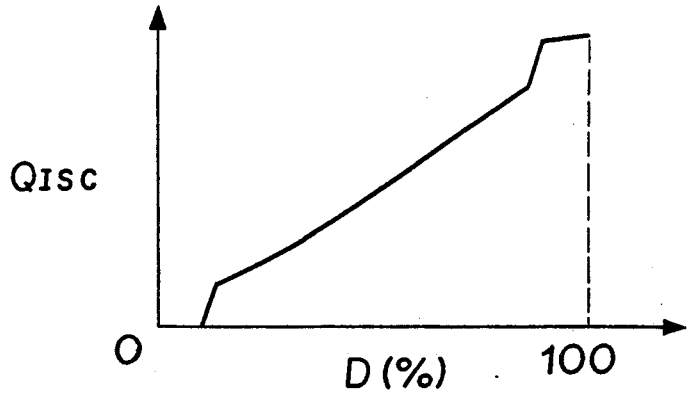
FIG. 6 is a diagram showing a relation of an ISC air quantity $Q_{ISC}$ to a duty ratio D.
Figure 7:
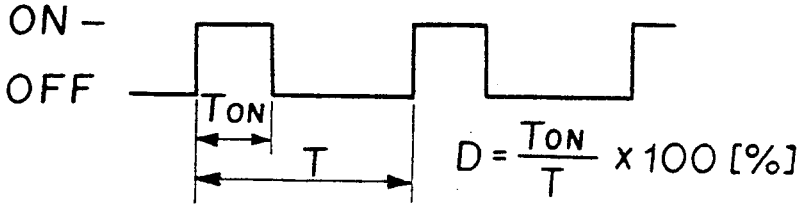
FIG. 7 is a diagram showing the duty ratio D.

At step S16, an ISC (idle speed control) air quantity $Q_{ISC}$ is obtained by summing the basic air quantity $Q_{BASE}$ and the engine speed feed-back correction quantity $Q_{NFB}$. At step S17, the duty ratio D of the driving signal is calculated by using a map which represents a relation of the ISC air quantity $Q_{ISC}$ to the duty ratio D as shown in FIG. 6. The duty ratio D is expressed by $$\frac{T_{ON}}{T} \times 100[\%]$$

where the period of the of the driving signal is D and a time of ON in one period is $T_{ON}$, as shown in FIG. 7.

At step S18, the driving signal having the duty ratio D is supplied to the air control valve 11 to actuate and control it. When the above-mentioned air quantities and correction quantities are large, the value of the duty ratio D becomes large, whereby the degree of opening of the air control valve 11 increases.

On the other hand, when it is found that the engine is in a non-idle state at step S5, step S19 is taken at which a predetermined air control quantity $Q_{OPEN}$ which is previously determined as the ISC air quantity $Q_{ISC}$ is set. Then, sequential step goes to step S17 to conduct the same operation as described above.

After the operation of step S18 has been finished, sequential step returns to step S1 to repeat the above-mentioned operations.

In the above-mentioned embodiment, after the operation of step S4, step S19 may be directly taken.

Although the fuel control system is separate from the ignition control system in the above-mentioned embodiment, these may be in the same program in the electronic type control unit 22. Further, the operations as shown in FIG. 3 may be excused as soon as an OFF signal from the ignition key switch is received.

Figure 8:
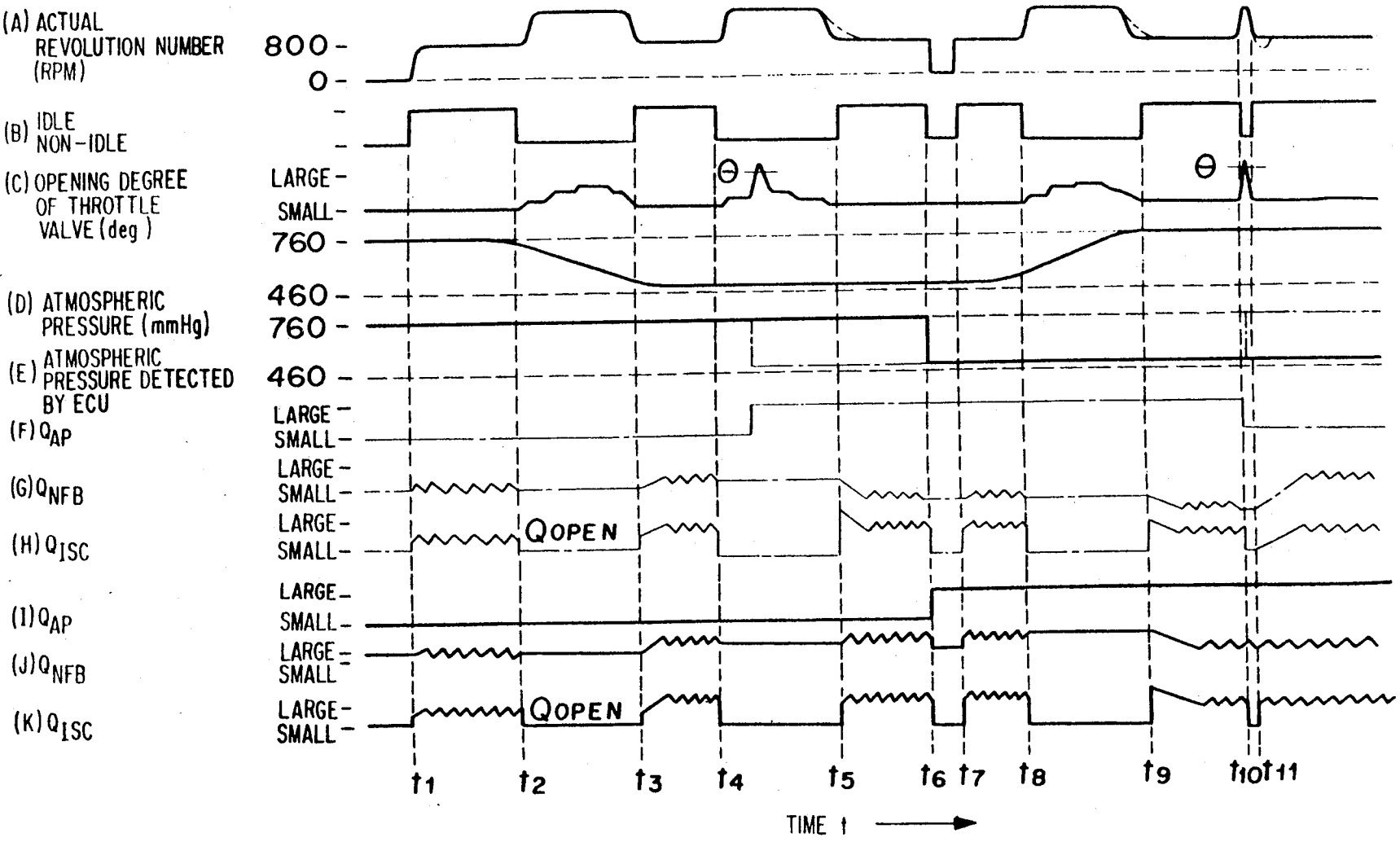
FIG. 8 is a diagram showing the waveforms of signals in the operations for comparing the operations according to the embodiment of the present invention with those of the conventional apparatus.
Figure 9:
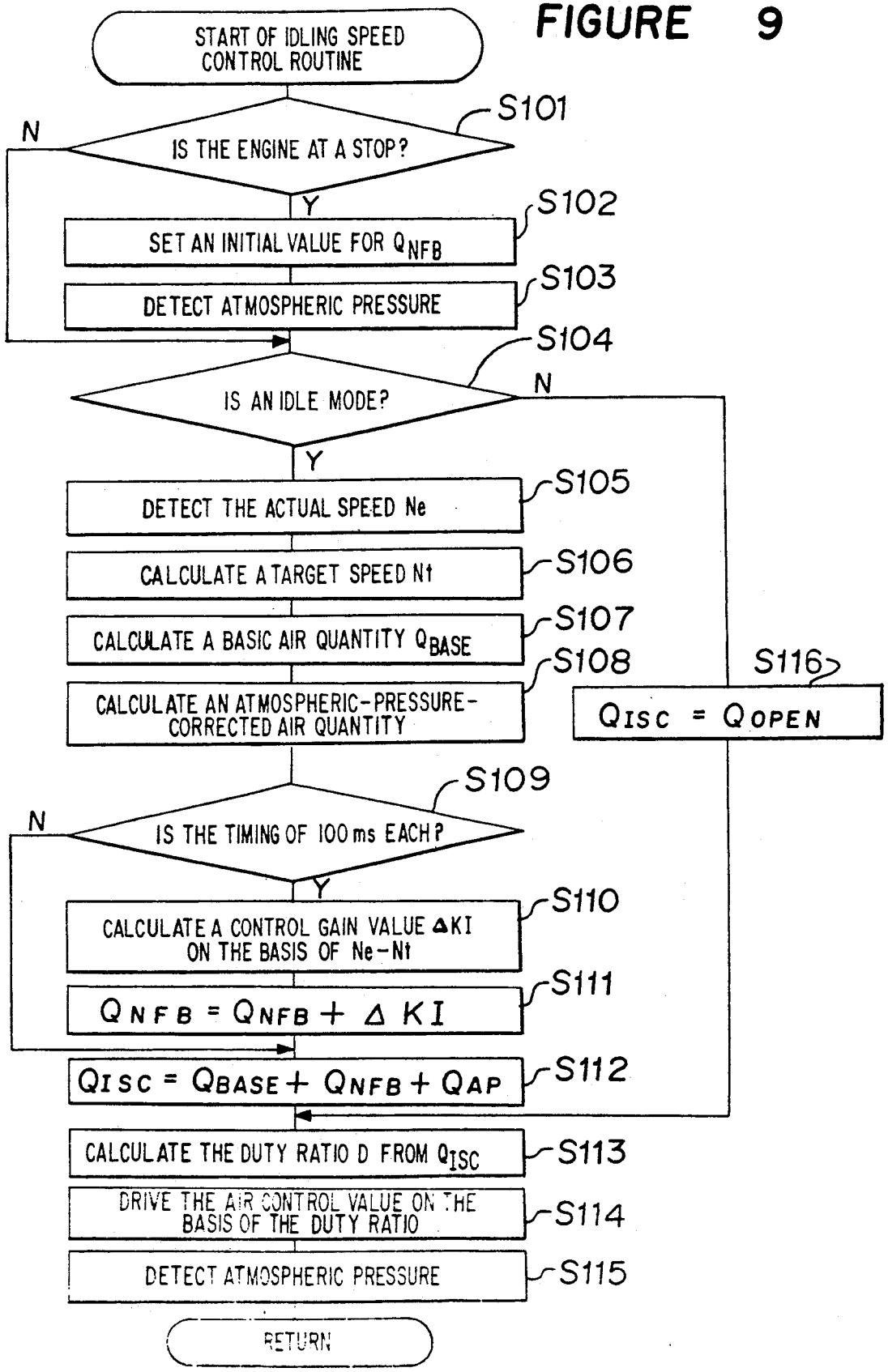
FIG. 9 is a flow chart showing the operations of the conventional apparatus.

FIG. 8 shows the waveforms of the signals in controlling the engine speed in the above-mentioned embodiment and the waveforms of the signals in the conventional control apparatus wherein solid lines indicate the waveforms of the embodiment of the present invention and one-dotted chain lines indicate the waveforms of the signals in the conventional apparatus.

In FIG. 8, A indicates the actual engine speed, B indicates the operational conditions: idle and non-idle, C indicates the degree of opening of the throttle valve, D indicates atmospheric pressure, E indicates atmospheric pressure detected by the pressure sensor 6, F indicates the atmospheric-pressure-corrected air quantity $Q_{AP}$ in the conventional control apparatus, G indicates the engine speed feed-back correction quantity $Q_{NFB}$ in the conventional control apparatus, H indicates the ISC air quantity $Q_{ISC}$ in the conventional apparatus, I indicates the atmosperic-pressure-corrected air quantity $Q_{AP}$ in the embodiment of the present invention, J indicates the engine speed feed-back correction quantity $Q_{NFB}$ in the present invention and K indicates the ISC air quantity $Q_{ISC}$ in the present invention. In the diagram of FIG. 8, the abscissa represents a time axis t.

In an idle state in a time period from the time t1 to the time t2, the atmospheric pressure is 760 mmHg, and the engine speed feed-back correction quantity $Q_{NFB}$ and the ISC air quantity $Q_{ISC}$ are respectively constant. When it is assumed that the vehicle moves from a low land to a high land and an atmospheric pressure changes, for instance, to about 460 mmHg. Then, in an idle state in a period from the time t3 to the time t4, the engine speed feed-back correction quantity $Q_{NFB}$ is increased so as to compensate a component of change of the atmospheric pressure, with the result that the ISC air quantity $Q_{ISC}$ is also increased to thereby provide a balanced condition.

In a non-idle state in a period from the time t4 to the time t5, the throttle valve opens at a degree of opening more than Θdeg. At this moment, the conventional control apparatus detects an atmosperic pressure of near 460 mmHg, whereby the atmosperic-pressure-corrected air quantity $Q_{AP}$ is increased.

In an idle state in a time period from the time t5 to the time t6, the ISC air quantity $Q_{ISC}$ increases so as to correspond to an increment in the atmosperic-pressure-corrected air quantity $Q_{AP}$ in the conventional control apparatus. Although the engine speed feed-back correction quantity $Q_{NFB}$ is decreased to cancel the increment of the atmosperic-pressure corrected air quantity, an excessive amount of air is supplied to the engine. Therefore, it is difficult that the actual engine speed reduces to the target speed.

However, the control apparatus of the present invention does not detect an atmosperic pressure in the above-mentioned conditions. In the embodiment of the present invention, correction in an amount of air based on the atmosperic pressure is not conducted in an idle state of the time period from the time t5 to the time t6, and the engine speed feed-back correction quantity $Q_{NFB}$ which has been corrected based on the atmosperic pressure at the time period t3–t4 is used. Accordingly, the actual engine speed is rapidly converged to the target speed. At a time period from the time t6 to the time t7, the ignition key switch is in an OFF state and the engine is stopped. At this moment, the control apparatus of this embodiment of the present invention detects an atmosperic pressure of about 460 mmHg.

In an idle state in a time period from the time t7 to the time t8 in both the conventional control apparatus and the control apparatus of the present invention, the initial value at an atmosperic pressure of 760 mmHg is set for the engine speed feed-back correction quantity $Q_{NFB}$, and the initial value is corrected by the atmosperic-pressure-corrected air quantity $Q_{AP}$. Accordingly, the ISC air quantity $Q_{ISC}$ becomes appropriate. After that, the atmospheric pressure is not detected unless the ignition key switch becomes an OFF state, and the correction is effected by the engine speed feed-back correction quantity $Q_{NFB}$.

However, in the conventional control apparatus, the correction of atmosperic pressure is effected in a time period from the time t9 to the time t10 in the same manner as that in the time period t3–t4. Under the conditions, when a non-load racing is effected at a time period from the time t10 to the time t11, the throttle valve opens at an opening degree of more than Θdeg, whereby an atmosperic pressure is detected. Just before the racing, the ISC air quantity $Q_{ISC}$ is in a balanced state at an atmosperic pressure of 760 mmHg by the correction of the engine speed feed-back correction quantity $Q_{NFB}$. However, the atmosperic pressure is detected immediately after the time t11 and the ISC air quantity $Q_{ISC}$ reduces for an amount of the reduction of the atmosperic-pressure-corrected air quantity $Q_{AP}$. Accordingly, an amount of air supplied to the engine is temporarily short, so that the actual engine speed is abnormally reduced.

As described above, the engine speed control apparatus of the present invention is adapted to correct a synthesized quantity obtained by synthesizing a basic air quantity and an engine speed feed-back correction quantity which depends on an error between an actual engine speed and a target speed, at the time of starting the engine. Accordingly, an abnormal reduction or increase of the engine speed in an idle state can be eliminated.

We claim:

1. An engine speed control apparatus for an internal combustion engine which comprises:
   - an air control valve which controls the cross-sectional area of a bypass passage provided so as to bypass the throttle value of the engine;
   - a control unit which controls a degree of opening of said air control valve on the basis of a synthesized quantity which is obtained by synthesizing a basic air quantity for maintaining a target engine speed and an engine speed feed-back correction quantity which effects to eliminate an error between the target speed and an actual engine speed;
   - an atmospheric pressure detecting means to detect an atmospheric pressure, and
   - a correction means for correcting said synthesized quantity based upon the detected atmospheric pressure every time the engine is started and only during an engine starting operation.

2. The engine speed control apparatus according to claim 1, wherein an engine-stop flag is set before an atmospheric-pressure-corrected air quantity is calculated on the basis of the atmospheric pressure detected by the atmospheric pressure detecting means.

3. The engine speed control apparatus of claim 2, wherein said engine speed feed-back correction quantity is set to equal an initial engine speed feed-back correction quantity plus said atmospheric-pressure-corrective air quantity when said engine-stop flag is set.

4. The engine speed control apparatus of claim 1, wherein said controller calculates a duty ratio from said synthesized quantity and uses said duty ratio to control the air control valve.

* * * * *